US006135510A

United States Patent [19]

Diginosa

[11] Patent Number: 6,135,510

[45] Date of Patent: Oct. 24, 2000

[54] EGRESS WINDOW LOCK

[75] Inventor: Anthony V. Diginosa, Mississauga, Canada

[73] Assignee: Royal Plastics Inc., Woodbridge

[21] Appl. No.: 09/302,419

[22] Filed: Apr. 30, 1999

[30] Foreign Application Priority Data

May 1, 1998 [CA] Canada ..... 2236497

[51] Int. Cl.[7] ..... E05C 1/04

[52] U.S. Cl. ..... 292/145; 292/DIG. 47

[58] Field of Search ..... 49/175, 183, 450, 49/161; 292/137, 138, 145, 175, DIG. 20, DIG. 47

[56] References Cited

U.S. PATENT DOCUMENTS

| | | | |
|---|---|---|---|
| 1,570,072 | 1/1926 | Merz | 292/150 |
| 3,083,419 | 4/1963 | Pennington | 49/450 |
| 4,146,256 | 3/1979 | Snider | 292/173 |
| 4,320,597 | 3/1982 | Sterner | 49/449 |
| 4,791,756 | 12/1988 | Simpson | 49/175 |
| 4,961,286 | 10/1990 | Bezubic | 49/175 |
| 5,090,750 | 2/1992 | Lindqvist | 292/7 |
| 5,158,329 | 10/1992 | Schlack | 292/87 |
| 5,193,707 | 3/1993 | Mizumura | 220/326 |
| 5,244,238 | 9/1993 | Lindqvist | 292/7 |
| 5,301,989 | 4/1994 | Dallman | 292/142 |
| 5,702,135 | 12/1997 | Burress | 292/145 |
| 5,715,631 | 2/1998 | Kailian | 49/450 |
| 5,791,700 | 8/1998 | Biro | 292/7 |

*Primary Examiner*—B. Dayoan
*Assistant Examiner*—Gary Estremsky

[57] ABSTRACT

A window lock for a slideable and tiltable window sash. The lock has a housing for attachment to a window unit to present a slideway extending transversely of the sliding movement of the window, and a locking member having a bolt at one end slideable in said housing slideway to move said bolt between a first maximum outwardly projecting sash locking position, a partially retracted sash sliding position for allowing vertical sash sliding movement, and a fully retracted sash tilting position.

20 Claims, 8 Drawing Sheets

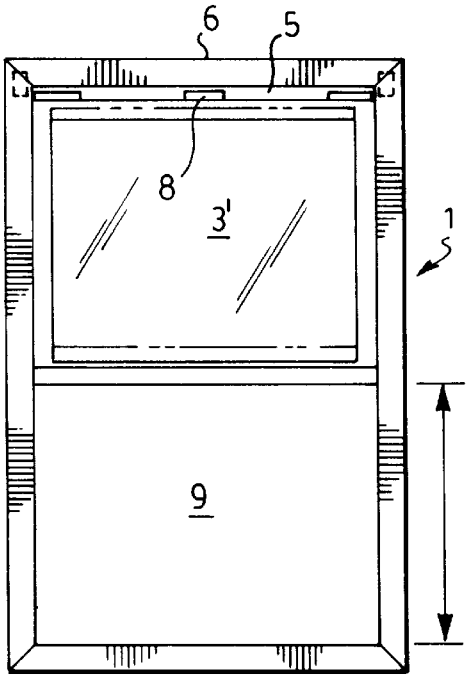
FIG.4.
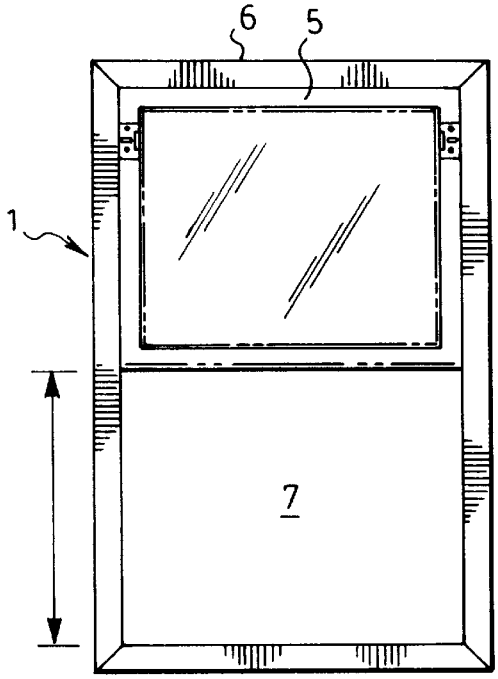
FIG.3.
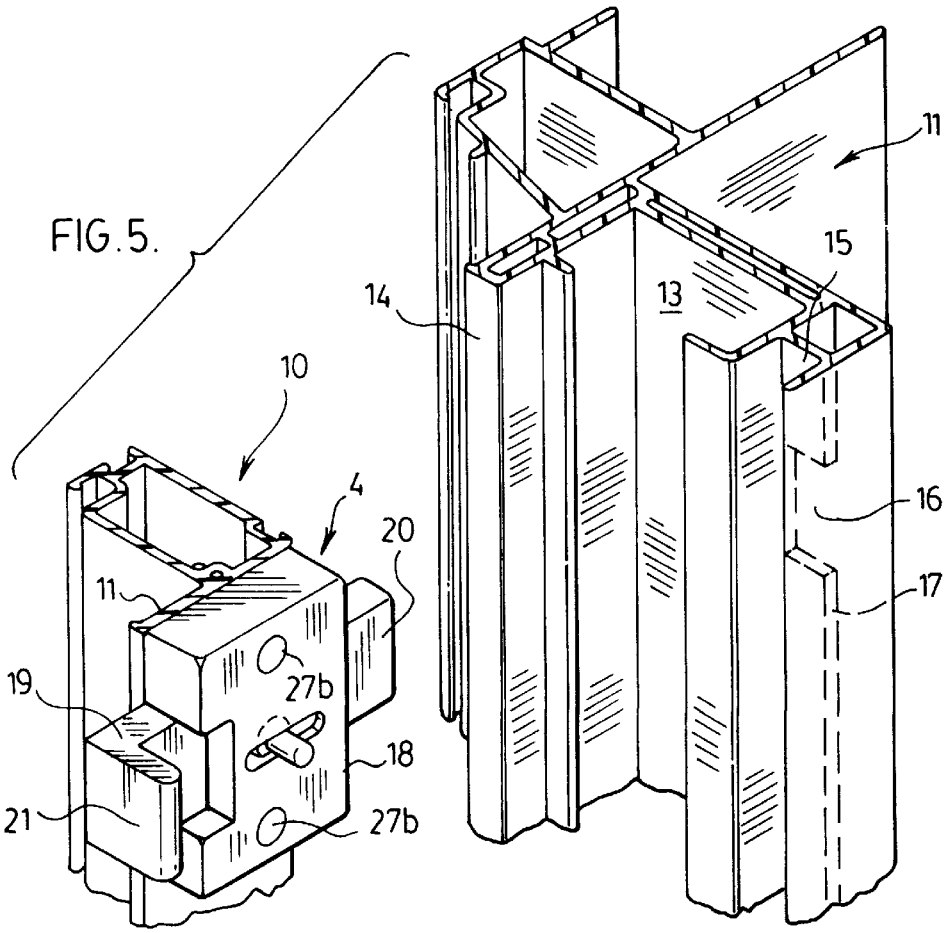

FIG. 6.
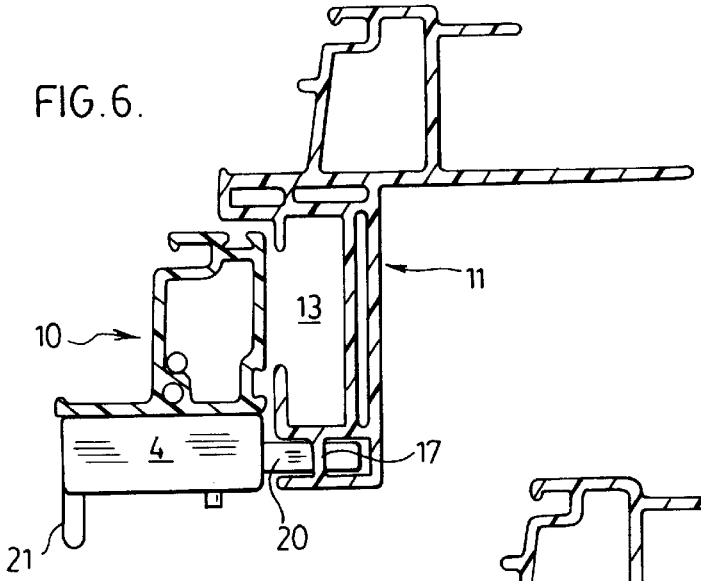
FIG. 7.
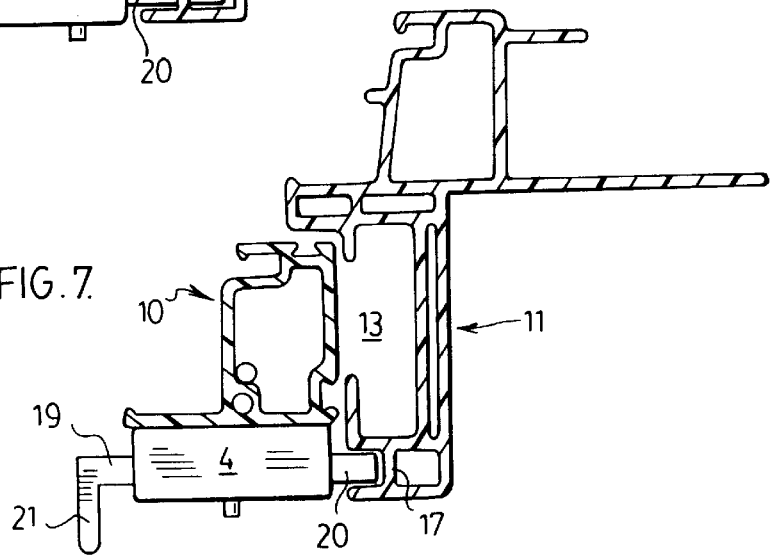
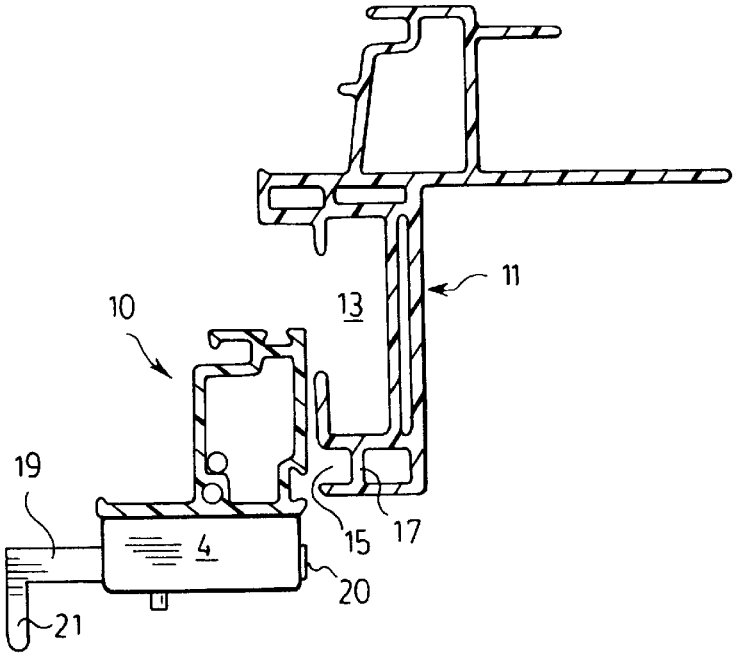
FIG. 8.

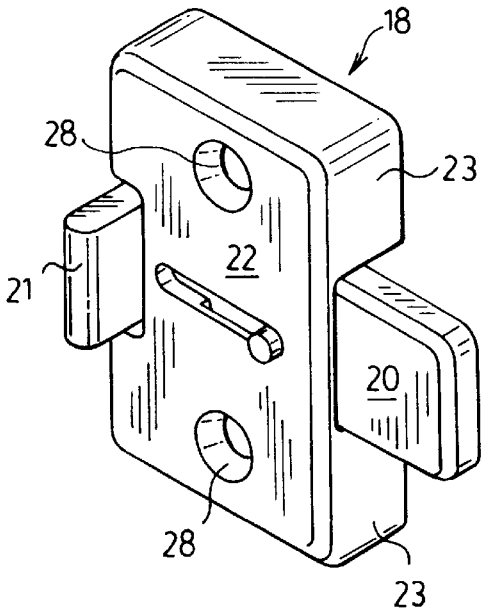
FIG.9.
FIG.10.
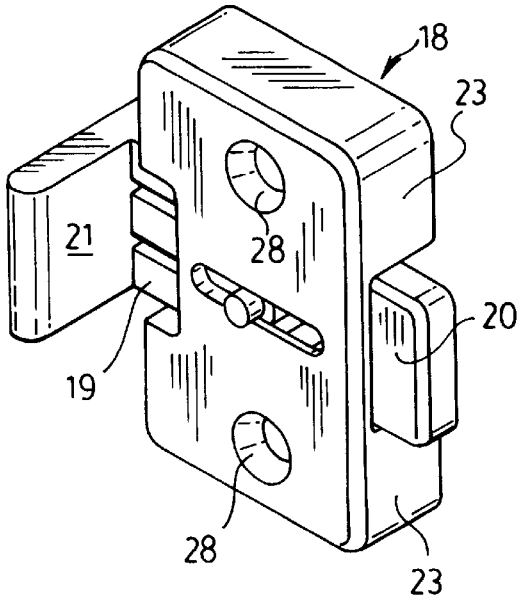
FIG.11.
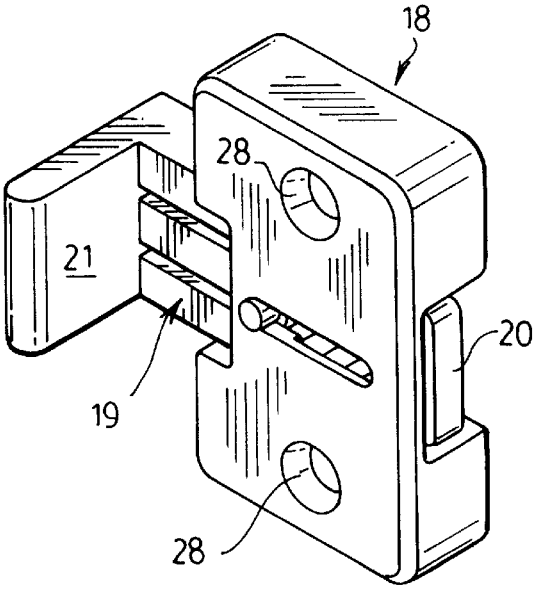

18
23
27
24
29
28
30
31
26
32
25
20
38
39
19
37
40
41
21
35

18
23
27
20
19
21

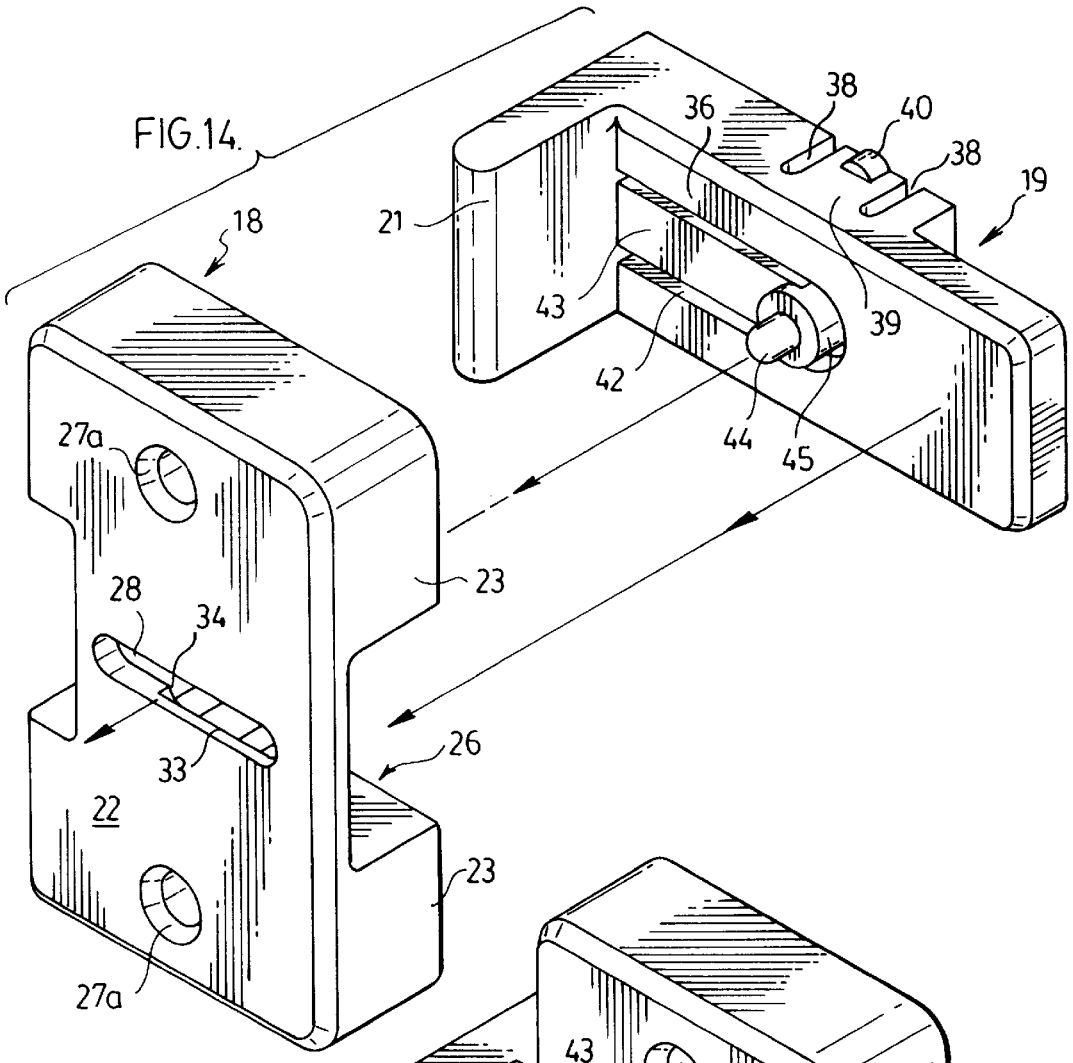
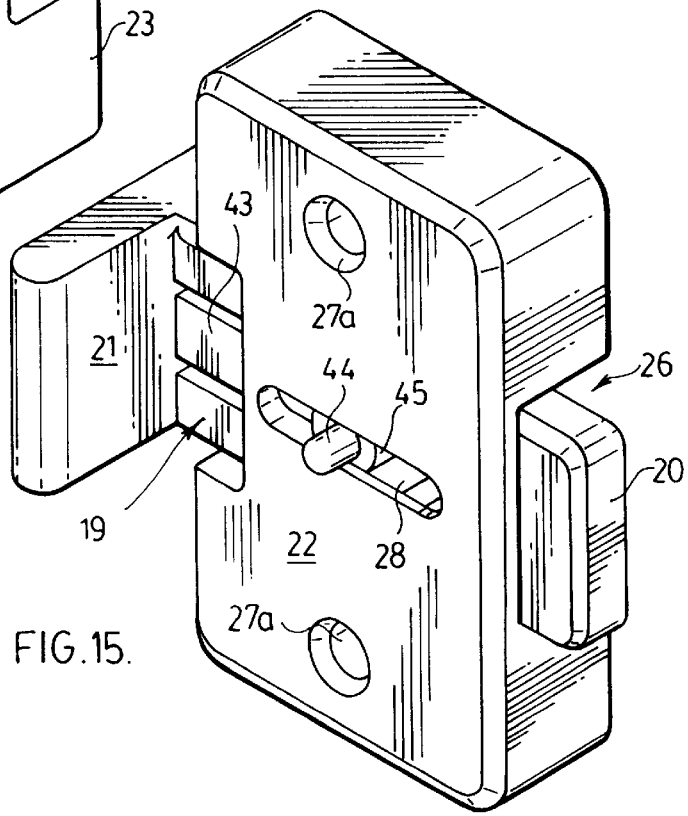
FIG.15.

EGRESS WINDOW LOCK

FIELD OF THE INVENTION

This invention relates to window locks and more particularly to locks for sashes which are both slideable and swingable or tiltable as found, for example, in single hung windows.

BACKGROUND OF THE INVENTION

At present, for locking sashes which are both slideable and tiltable or swingable as, for example, the vertically sliding and tilting lower sashes of single hung window units the locks are mounted on top of the lower sash header to engage cooperating locking members or keepers mounted on the sill of the upper sash. Two additional pieces of hardware are provided one at each side of the lower sash to retain it against tilting. These latter locking members normally incorporate spring actuated metal plungers which engage in trackways provided in the window frame jambs to prevent unwanted sash tilting. On retraction of the plungers, the lower sash can be tilted about its bottom pivotal connections with its retaining shoes which in turn slide within trackways in the window frame jambs.

Such present hardware is expensive and the presence of a lock on top of the lower sash header limits the upward movement of the lower sash in the window frame. Similarly, if the sash is slideably horizontally, the lock on one end of the sash limits its horizontal opening movement.

By so limiting the movement of the sash, the size of the opening, that is the egress opening, available when the sash is fully open is restricted. Thus, for a given size of egress opening as required by many jurisdictions in which the window is installed, the size of the window frame must be such that it allows for the sliding movement of the sash to provide the required egress opening plus an additional size to accommodate the lock mounted on the top or end of the sash.

This requirement to accommodate the sash lock to achieve a requisite egress opening for safety adds significantly both to the window frame size and the sash area required to close the window frame adding significantly to the cost of the window installation.

It is the object of the present invention to provide a novel and extremely reliable low cost lock which will eliminate the present sash lock thereby increasing the egress opening, will provide a very positive locking of the sash in the closed position or at various open positions and will also allow for the tilting or swinging of the sash for cleaning or reglazing the window.

It is a further object of the invention to provide a lock as aforesaid which incorporates a safety mechanism which will prevent accidental unwanted tilting or swinging of the sash.

It is a further object of the invention to provide such a lock which can be produced by injection molding.

SUMMARY OF THE INVENTION

The invention resides in providing a lock for a slideable and tiltable or swingable window sash of a window unit, the lock comprising a housing for mounting on the window unit to present a slideway extending transversely of the sliding movement of the sash and a locking member having a bolt end slideable in the housing slideway to move the bolt end between an intermediate projecting position for riding in a trackway to retain and guide the window sash for sliding movement, a fully projecting position to engage in a slot in the bottom of the trackway to lock the sash, and a fully retracted position clear of the trackway to allow tilting or swinging of the sash, the housing and locking member having cooperating means to releasably retain the locking member when moved to the correct sash locking, sliding, and tilting positions.

A further aspect of the invention resides in forming the housing and locking member to provide a spring releasable positive stop preventing accidental movement of the bolt from the sash sliding to the sash tilting or swinging position.

In another aspect, the invention involves a lock incorporating the aforesaid features in which both the housing and the locking member can be formed by injection molding.

BRIEF DESCRIPTION OF THE DRAWINGS

FIG. 3 is an elevational view of the window of FIG. 1 showing the lower sash in the fully raised position.

FIG. 4 is an elevational view of the window frame shown in FIGS. 1, 2 and 3 but showing the lower sash with the prior art top lock in the fully raised position.

FIG. 5 is an exploded fragmentary perspective view illustrating one of the lower sash jambs to a which a lock of the present invention has been attached and a window frame jamb on which the lower sash jamb is adapted to slide.

FIG. 6 is a plan view of the lower sash jamb and door frame jamb illustrated in FIG. 5 and showing the lock in its sash locking position.

FIG. 7 is a view similar to FIG. 6 but showing the lock in its sash sliding position.

FIG. 8 is a view similar to FIGS. 6 and 7 but showing the lock in the sash tilting position.

FIG. 9 is a perspective view of the lock with its bolt extended to the locking position corresponding to FIG. 6.

FIG. 10 is a perspective view of the lock showing the bolt partially retracted to the window sliding position corresponding to FIG. 7.

FIG. 11 is a perspective view of the lock showing the bolt fully retracted corresponding to the sash tilting position of FIG. 8.

FIG. 14 is an exploded perspective view of the housing and locking member looking from the outside of the housing.

FIG. 15 is a perspective view of the housing and locking member shown in FIG. 14 assembled with the bolt in the sash sliding position.

DETAILED DESCRIPTION ACCORDING TO THE PREFERRED EMBODIMENTS OF THE PRESENT INVENTION

By way of illustration, the lock of the present invention will be described as applied to a vertically slideable and tiltable sash but it will be understood that it can equally be applied to a horizontal slideable sash which can be swung out or "tilted" for cleaning and glazing.

Figure 1:
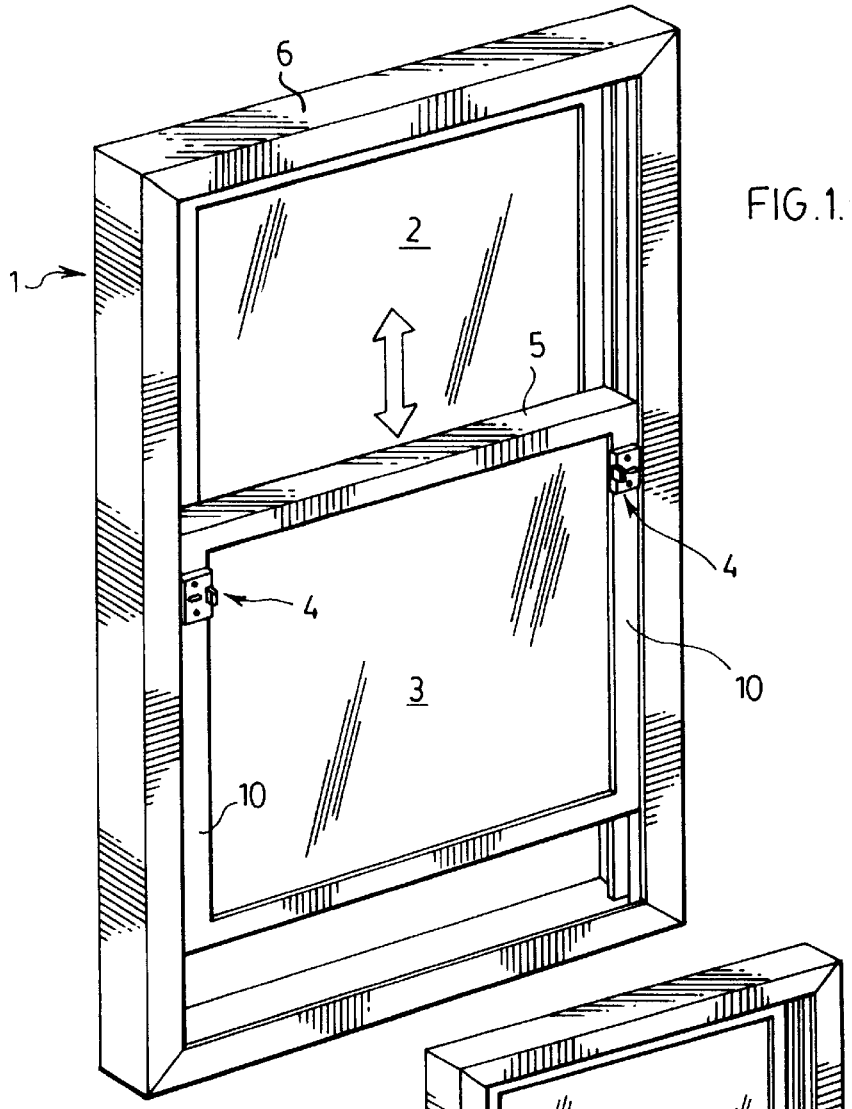
FIG. 1 is a perspective view showing the lock of the present invention applied to a single hung window having a vertically slideable and tiltable or swingable lower sash and showing the sash in a partially raised position.

With reference to the Figures, FIG. 1 shows a window unit comprising a window frame generally designated at 1 incorporating a fixed upper sash 2 and a slideable and tiltable lower sash 3 to which the locks of the present invention generally designated at 4 have been applied.

Figure 2:
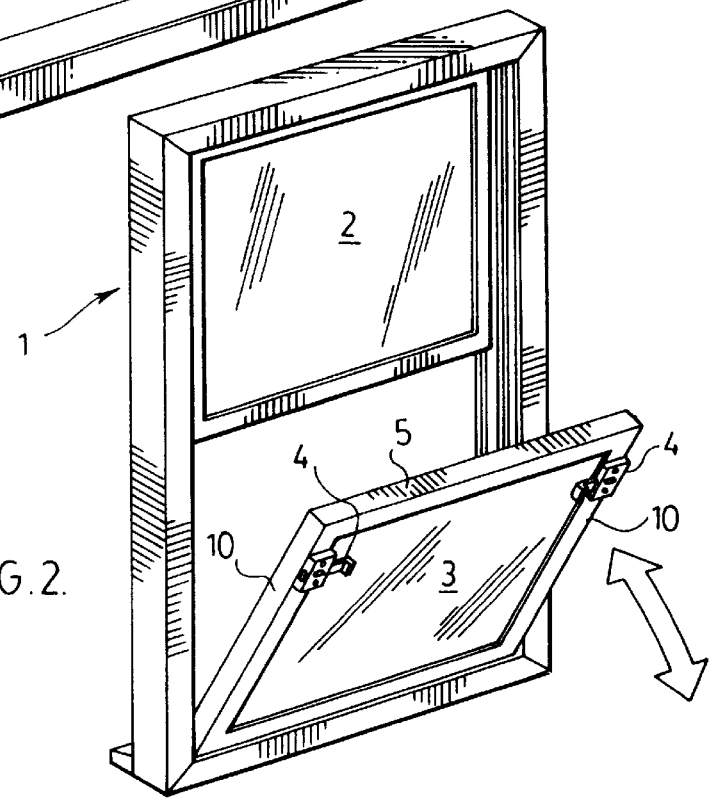
FIG. 2 is a perspective view of the window of FIG. 1 showing the lower sash in a tilted position.

FIG. 1 shows the lower sash 3 slid vertically upwardly to a partially open position while FIG. 2 shows the lower sash 3 in a tilted position.

FIG. 3 is a front elevational view of the window unit of FIG. 1 but showing the lower sash raised to its fullest extent with its header 5 abutting the header 6 of the window frame leaving an egress or escape opening 7.

FIG. 4 shows a lower sash 3' corresponding to the sash 3 but provided with the conventional top lock 8. The presence of this top lock limits upward sash movement preventing the header of the sash 3' reaching the header of the window frame 1. As a result, the egress or escape opening 9 provided with the sash 3' fully raised is significantly less than the egress opening 7 achieved with the use of the locks 4 of the present invention.

In many jurisdictions there is a minimum area of egress opening required to enable escape through the window. If the egress opening 7 meets the minimum standards required, the egress opening 8 would be unacceptable. To increase the egress opening 8 would then involve increasing the size of the window frame and as well the sizes of the sashes to fill the frame greatly increasing the cost of the window unit.

FIG. 5 is an illustration of an application of the use of the locks of the present invention where the lock 4 has been secured to the sash jamb 10 adapted for sliding on the frame jamb 11.

The jambs 10 and 11 are generally typical extrusions with the sash jamb 10 having a face 12 to which the lock 4 is shown mounted and with the frame jamb 11 having a trackway 13 to slideably receive the conventional shoe (not shown) to which the bottom of the sash 3 is pivoted for the tilting action. The frame jamb 11 is also provided with a flange 14 to prevent outward sash movement and a bolt receiving track 15 having one or more openings or notches 16 in the bottom wall 17 thereof for a purpose as will hereinafter appear.

The lock 4 comprises two parts, a housing 18 for mounting the lock on the sash jamb 10 and a locking member 19 slideable in the housing and having an end in the form of a bolt 20 and a finger grip 21.

As will be seen from FIGS. 6, 7 and 8, the width of the housing 18 of the lock 4, that is the measurement taken in the direction that the locking bolt 20 slides is substantially the same as the width of the sash frame member or jamb 10. Also, as seen in FIG. 6, with the lock bolt moved to its fully locked position, the finger grip 21 is flush with the outer edge of the housing 18. Thus, except for the projecting locking bolt 20, in the fully locked position, the remainder of the lock 4 lies within the edges of the sash frame member or jamb 10.

With the lock 4 mounted to the face of the sash frame member or jamb 10, the locking member 19 has three operating positions illustrated in FIGS. 6, 7 and 8. FIG. 6 shows the position in which the bolt 20 is fully extended projecting into the trackway 15 and through the notch 16 to lock the sash from sliding movement in the window frame. It will be understood that the location of the trackway opening or notch 16 will register with the bolt 20 with the lower sash fully closed to lock the sash in the closed position. Other notches may be provided in the trackway 15 to enable the window to be locked against sliding movement in various raised positions as desired.

FIG. 7 shows the bolt 20 retracted from the opening 16 in the track bottom wall 17 but contained within the trackway enabling the sash to be slid vertically with the bolt riding in the trackway but preventing inward tilting or falling of the sash.

FIG. 8 shows the bolt 20 fully retracted from the trackway 15 to allow tilting of the sash about its pivotal connection with the bottom shoes as will be understood.

FIGS. 9, 10 and 11 show the three positions of the locking member corresponding to FIGS. 6, 7 and 8, that is, with the bolt fully extended to the sash locking position in FIG. 9, the bolt partially retracted to the sash sliding position in FIG. 10 and the bolt fully retracted to the sash tilting position in FIG. 11.

FIGS. 12 to 20 show the details of the lock housing 18 and slideable locking member 19 which are formed as injection molded parts of nylon or nylon reinforced with glass or other suitable material which will give equivalent strength and durability it being understood that such parts can be produced in large volume at relatively low cost.

The housing 18 which is of channel shape comprises a face plate 22 carrying two spaced generally rectangular box sections 23 projecting laterally therefrom with the opposing walls 24 of the sections 23 being parallel and defining with the portion 25 of the face plate 8 spanning therebetween a slideway 26 to slideably receive the locking member 19. It will be understood that with the channel shaped housing mounted on the sash jamb as illustrated the jamb will close the open side of the housing providing a closed slideway for containing the locking member 19.

The box sections 23 of the housing have centrally thereof a hollow fastener receiving column 27 opening at **27*a* through the face plate 22. Suitable fasteners 28*b* projected through the openings 27*a* and columns 27 enable the housing 18** to be easily and quickly fastened at an appropriate position on the sash with the slideway extending perpendicular to the sash jamb.

As shown, eg. in FIGS. 14 and 15, the portion 25 of the face plate 22 between the box sections 23 has an longitudinal slot 28 therein extending longitudinally of the slideway 26 and exposed centrally thereof.

Figure 12:
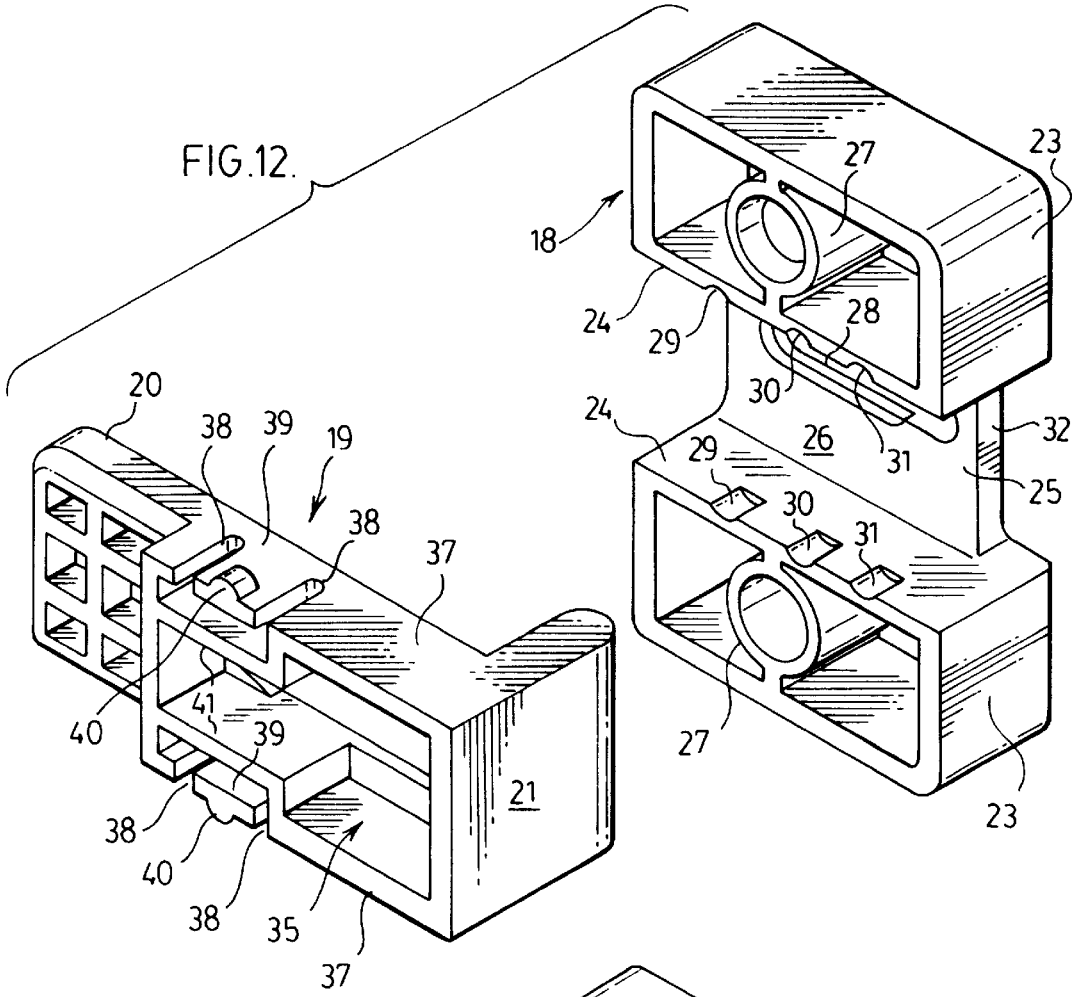
FIG. 12 is an exploded perspective view looking from the inner side of the casing and the bolt carrying locking member.

As shown particularly in FIG. 12, the opposing walls 24 of the box sections 23 are provided with registering locating notches 29, 30 and 31 corresponding to the sash locking, sash sliding and sash tilting positions of the locking member respectively.

One side the face plate portion 25 is notched as at 32 to enable the end of the locking member 19 provided with the finger grip 21 to lie flush with the respective sides of the box sections 23 with the locking member moved to sash locking position.

Figure 18:
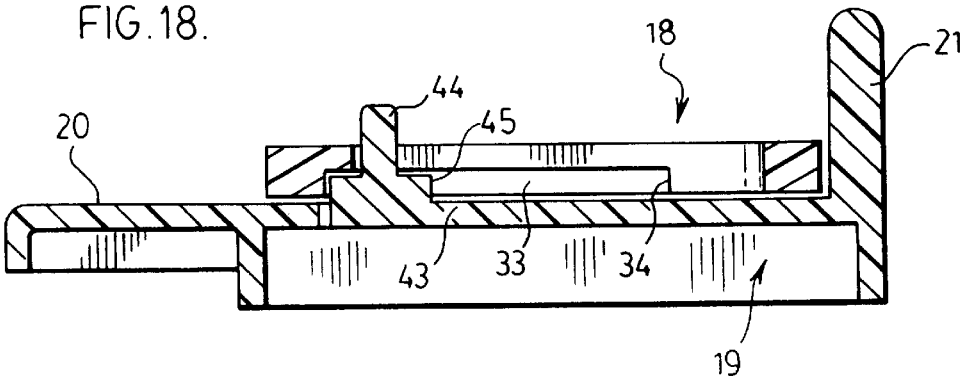
FIG. 18 is a horizontal section through the lock showing the bolt in the sash locking position showing the button carried by the locking member cantilever spring projecting through the housing slot.
Figure 19:
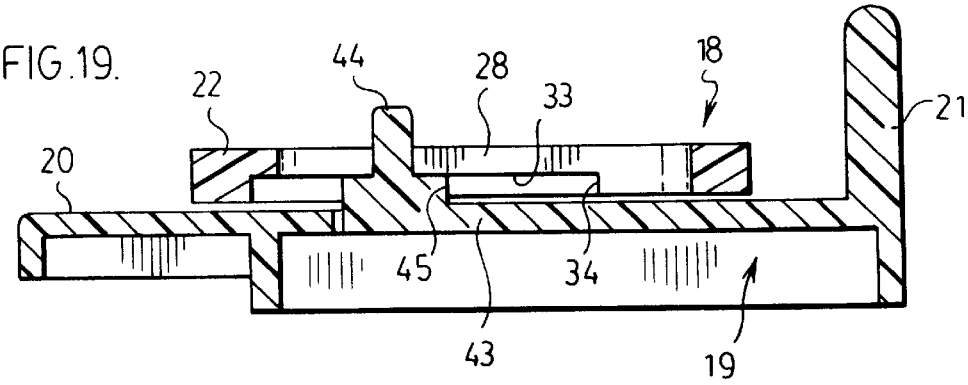
FIG. 19 is a view similar to FIG. 18 but showing the locking member moved to retract the bolt with the shoulder of the button carried by the locking member spring cantilever riding on the inner surface of the housing slot towards a stop shoulder provided towards the outer end of the housing slot.
Figure 20:
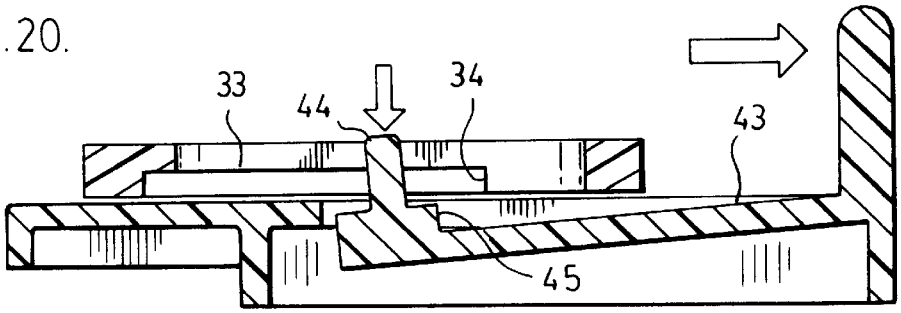
FIG. 20 is a view similar to FIG. 19 but showing the locking member further retracted to further retract the bolt end with the button depressed to clear its shoulder inwardly of the housing stop shoulder to allow for total retraction of the bolt to the sash tilting position.

As shown in FIG. 14 and more particularly in FIGS. 18 to 20, the wall of the slot 28 is reduced in thickness over a length indicated at 33 corresponding to the distance of the movement of the locking bolt from the sash locking to the sash sliding position and forms a stop shoulder 34 rearwardly of the bolt sash sliding position, that is, between the sash sliding position and the sash tilting position. This stop shoulder 34 is provided to prevent accidental movement of the locking member to the sash tilting position thus providing an important safety feature as hereinafter more fully explained.

Figure 13:
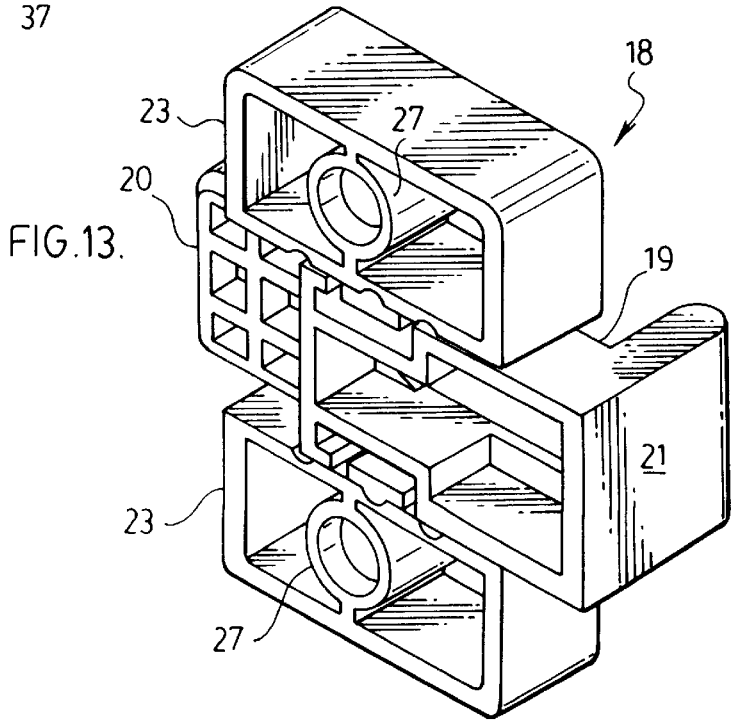
FIG. 13 is a perspective view showing the locking member assembled with the housing with the bolt in the sash sliding position.

With reference to FIGS. 12 and 14 in particular, the locking member 19 has a box section 35 adapted to snugly slide in the housing slideway 26 as shown in FIG. 13.

The side of the box section 35 facing the housing section 25 is closed by a planar slide portion or plate 36 which extends outwardly to form part of the thickened generally planar bolt end 20 as shown in FIG. 14.

The opposing walls 37 of the box section 35 of the locking member which slide along the opposing walls 24 of the slideway 26 are slotted as at 38 to provide short cantilever sections 39 which have a measure of resiliency. These cantilever sections 39 carry outwardly projecting rounded detentes 40 at their free ends for engagement in the respective notches or grooves 29, 30 and 31 in the slideway walls 24 for accurately locating the locking member in the fully extended sash locking bolt position, the partially retracted sash sliding bolt position, and the fully retracted sash tilting bolt position.

For strengthening of the box section 35 of the locking member, the cantilevers 39 are bridged by spaced walls 41 located interiorly of the box section.

As illustrated particularly in FIG. 14, the sliding or plate portion 36 closing one side of the box section 35 is provided with an elongated U-slot 42 defining an elongated cantilever arm 43 extending lengthwise of the locking member and centrally thereof. A button 44 is mounted at the free end of the cantilever 43 through a shoulder abutment 45.

With the locking member assembled with the housing as shown, for instance, in FIG. 15, the button 44 is projected through the housing slot 28 with the shoulder abutment 45 contacting the surface of the housing face portion 25 along the thinned portion 33 of the slot 28.

Figure 16:
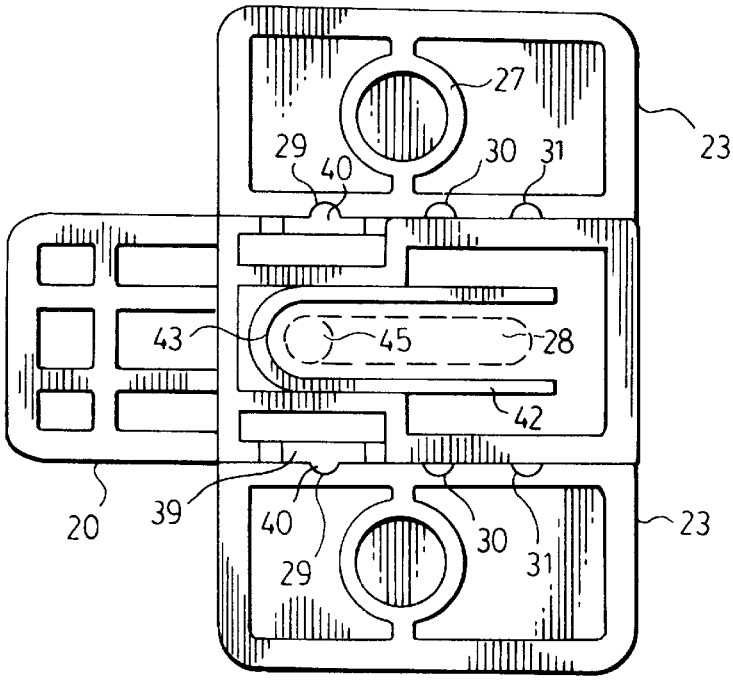
FIG. 16 is an elevational view looking at the inner side of the lock and showing the locking member in the fully extended bolt position for locking the lower sash.

FIG. 16 shows the locking member 19 in the sash locking position with the bolt end 20 fully extended and with the detentes 40 carried on the short cantilevers 39 of the locking member seated in the grooves or notches 29 of the housing slideway walls 24 to provide an overcomable resistance to the retraction of the locking member from the sash locking position.

Figure 17:
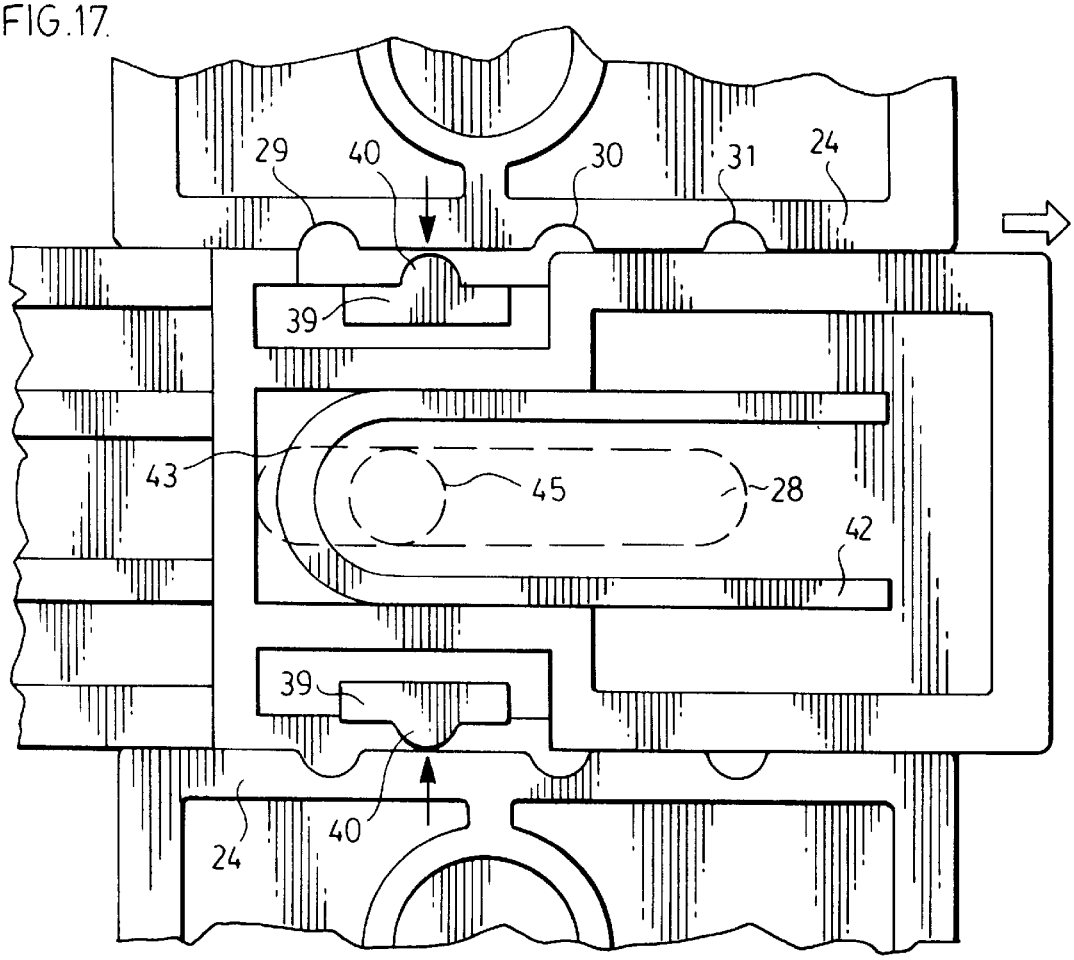
FIG. 17 is an enlarged view similar to FIG. 16 but showing the locking member moved to a position in which the bolt is partially retracted between the sash locking and sash sliding positions.

FIG. 17 shows the commencement of the retraction of the locking member towards the sash sliding position which will be obtained when the detentes 40 register with the grooves 30.

During this retraction movement of the locking member, the button 44 will remain exposed and move in the housing slot 28 with the abutment shoulder 45 moving freely in the section 33 of the slot having a reduced thickness until the bolt is retracted to the sash sliding position. Thereafter interference between the abutment shoulder 45 and the stop shoulder 34 will prevent any further retraction of the locking member so that accidental movement of the bolt from a partially retracted sash sliding position to the sash tilting position is precluded. This arrangement prevents any unwanted inward tilting of the sash that might cause injury or breakage of the glass.

When however it is desired to fully retract the bolt to the sash tilting position, the elongated cantilever 43 provides sufficient resilience that by depressing the button 44 as shown in FIG. 20 the abutment shoulder 45 can be moved clear of the stop shoulder 34 allowing the complete retraction of the bolt 20 for the sash tilting operation.

In the illustrations the locks 4 are shown mounted on the sash jambs 10 adjoining the tops thereof. It will be appreciated that they may also be mounted on the ends of the sash header 5 or any position relative to the sash 3 and window frame 1 such that the bolt 20 engages in a guiding and retaining slot in the intermediate sash sliding position, enters a notch in the bottom of the slot in the sash locking position and is retracted clear of the slot in the sash tilting position.

While the operation of the lock has been described in connection with a vertically slideable and tiltable sash, it can equally as well be used on horizontally slideable sashes which can be swung out (usually referred to as tiltable) for cleaning and glazing.

It will be understood that the use of the lock of the present invention whether on a vertically slideable or a horizontally slideable "tiltable" sash, will provide for maximum area of egress opening with minimum sash area for a given window frame area.

It will also be understood that with the lock of the present invention a simple lock mounted at each side of the sash performs all of the window functions required eliminating the need for the relatively expensive and additional hardware presently required to achieve these functions.

Further, the lock of the present invention provides an important safety feature avoiding accidental or unwanted sash tilting or swinging which can occur with conventional lock arrangements.

It will also be understood that variations in details of the lock components may be made without departing from the scope of the appended claims.

The embodiments of the invention in which an exclusive property or privilege is claimed are defined as follows:

1. A window lock mounted on a slidable and tiltable or swingable window sash, said lock having a channel shaped housing for attachment to the face of a frame member of a sliding sash of a window unit to present a slideway extending transversely of the sliding movement of the sash, said housing having a width measured lengthwise of said slideway substantially equal to the width of the sash frame member to fit within the edges of the sash frame member, a locking member having a bolt at one end and a projecting finger grip at the other end, said locking member being slideable in said housing slideway to move said bolt between a first maximum outwardly projecting sash locking position with projecting small grip in abutment with said housing at the end of said slideway opposite to the end from which said bolt projects, a partially retracted sash sliding position for allowing sash sliding movement, and a fully retracted position for allowing sash tilting or swinging.

2. A lock as claimed in claim 1 in which said housing has a transverse slot therein having a length corresponding to the travel of said bolt from the sash locking to the sash tilting or swinging positions, said locking member having a projection projecting through said slot to limit locking member travel and to indicate the bolt position, and cooperating means between said housing and locking member for releasably retaining said bolt in each of said sash locking, sash sliding and sash tilting positions.

3. A lock as claimed in claim 1 or 2 having releasable stop means to positively block sliding movement of said bolt from said sash sliding position to said sash tilting or swinging position, and means for releasing said releasable stop means to permit sliding movement of said bolt to said sash tilting or swinging position.

4. A lock as claimed in claim 2 in which said housing and said locking member are injection molded members.

5. A lock for a vertically slideable and tiltable window sash slideable in the jambs of a window frame each having a sash shoe trackway and a bolt receiving trackway said bolt receiving trackway having at least one notch in the bottom wall thereof, said lock comprising a channel shaped housing for mounting on the face of a sash frame member and having a dimension adapted to fit between the sides of the sash jamb member to present a slideway having spaced parallel walls extending perpendicularly to the jamb of the sash and in registration with the at least one notch in the recessed trackway with the sash in the closed position, and a locking member slideably mounted in said slideway, said slideable locking member having a planar bolt end moveable on sliding of said locking member between a sash locking position fully projecting from said housing to project into said bolt receiving trackway and through the at least one notch in the bottom wall of said bolt receiving trackway, an intermediate retracted sash sliding position in which said bolt is retracted from said at least one notch while remaining in said bolt receiving trackway, and a fully retracted sash tilting position clear of said bolt receiving trackway, said housing and locking member having cooperating means to accurately locate and releasably retain said locking member in said sash locking, sliding and tilting positions, said locking member having a projecting finger grip for slideably operating said locking member and further comprising walls of said housing slideway being provided with notches at the fully extended bolt position, the intermediate bolt position, and the fully retracted bolt position, and said locking member is formed with spring-biased detentes to engage in said notches.

6. A lock as claimed in claim 5 in which said housing and locking member are formed to provide a disengageable stop blocking slideable movement of said locking member to retract said bolt from said intermediate position to said fully retracted position, and means are provided to disengage said stop to permit retraction of said bolt to said fully retracted position.

7. A lock for a slideable and tiltable or swingable sash, said lock comprising a channel shaped housing for mounting on the face side of a frame jamb member of a sash said housing having a dimension adapted to fit between the edges of the frame jamb member with said channel facing the face of the sash frame member and with its axis perpendicular thereto, a longitudinal axially extending slot in the bottom wall of said channel, a locking member having a bolt at one end slideably mounted in said channel and having a slide limiting projection projecting through said channel slot, the arrangement being such that said locking member is slideable to move said bolt between a maximum projecting sash locking position with said slide limiting projection at one end of said housing slot, an intermediate partially retracted sash sliding position, and a fully retracted sash tilting position with said slide limiting projection at the other end of said housing slot, said housing and said locking member having cooperating means to accurately locate and releasably retain said bolt end in said intermediate position.

8. A lock as claimed in claim 7 in which said channel has spaced parallel walls and said cooperating means to accurately locate and releasably retain said bolt in said intermediate position comprises a notch in each of said parallel walls channel and a detente carried on a spring cantilever on opposite sides of said locking member, said channel wall notches being located so that said spring cantilever carried detentes register with and engaged in said parallel channel wall notches with said bolt in said intermediate position.

9. A lock as claimed in claim 8 in which said parallel channel walls have corresponding notches located so that said spring cantilever carried detentes register with and snap into said corresponding notches of said parallel channel walls with said bolt fully extended and fully retracted.

10. A lock as claimed in claim 9 in which said projection projecting through said slot comprises a button carried on a cantilever spring arm and having a shoulder riding on the inside of said channel slot between said fully extended bolt position and said intermediate bolt position, a stop surface provided on the inside of said channel slot for engaging said button shoulder to block sliding movement of said locking member from said intermediate position to said fully retracted position while permitting such sliding movement to said fully retracted position on pressing said button member to clear said shoulder from said stop surface.

11. A lock housing for an egress lock for a sliding and tilting or swinging window sash comprising a planar backing, a pair of spaced mounting feet projecting from said backing, for mounting said housing on the face of a sash frame member said mounting feet having a dimension in a direction transverse their spacing adapted to fit within the width of a sash frame member said feet being hollow and having spaced opposed parallel walls forming with said backing a channel slideway for slideably receiving a locking member, said backing having a slot therein centrally of said channel slideway and parallel to said spaced opposing parallel walls to receive a locking member projection and said opposed parallel walls having locking member location indents therein.

12. A lock housing as claimed in claim 11 in which said hollow feet each have therein a hollow fastener receiving column projecting from said backing and opening therethrough.

13. A lock housing as claimed in claim 12 formed from a material selected from one of nylon and nylon and glass.

14. A lock housing as claimed in claim 11 or 12 in which said mounting feet are generally rectangular.

15. A lock housing as claimed in claim 11 in which said backing is recessed at one end of said slideway.

16. A lock housing as claimed in claim 15 in which said slot in said backing is formed with a stop shoulder adjacent said backing recess.

17. An injection molded locking member for slideably mounting in a housing slideway comprising a rectangular box section having spaced sidewalls closed on one face by a flat slide plate extending outwardly beyond said box section to present a flat projecting bolt section, each of said sidewalls of said box section being slotted to present a spring cantilever extending perpendicular to said slide plate, each of said spring cantilevers having an outwardly projecting detente at its free end for engagement with an indent in a housing slideway, and a finger grip projecting from said box section.

18. A lock member as claimed in claim 17 in which said slide plate is formed with an elongated U-slot to provide a longitudinal spring cantilever extending in the direction of said bolt section and between said sidewalls, a button carried on the free end of said elongated cantilever projecting outwardly of said slide plate in the direction of said finger grip, said button being joined to said free end of said elongated cantilever by a shoulder formation.

19. A lock member as claimed in claim 17 or 18 provided with an interior wall bridging under said detente carrying cantilever arms formed in said sidewalls of said box section.

20. A lock member as claimed in claim 17 formed from a material selected from one of nylon and nylon and glass.

* * * * *